US012296432B2

(12) United States Patent
Palushaj

(10) Patent No.: US 12,296,432 B2
(45) Date of Patent: May 13, 2025

(54) FLOOR POLISHING APPARATUS

(71) Applicant: Diamabrush LLC, Madison Heights, MI (US)

(72) Inventor: Simon Palushaj, Washington, MI (US)

(73) Assignee: Diamabrush LLC, Madison Heights, MI (US)

( * ) Notice: Subject to any disclaimer, the term of this patent is extended or adjusted under 35 U.S.C. 154(b) by 1304 days.

(21) Appl. No.: 16/995,875

(22) Filed: Aug. 18, 2020

(65) Prior Publication Data

US 2021/0053188 A1 Feb. 25, 2021

Related U.S. Application Data

(60) Provisional application No. 62/888,847, filed on Aug. 19, 2019.

(51) Int. Cl.
*B24D 13/14* (2006.01)
*B24B 7/18* (2006.01)
(Continued)

(52) U.S. Cl.
CPC ..... *B24D 13/142* (2013.01); *B24D 7/06* (2013.01); *B24D 9/08* (2013.01); *B24D 13/145* (2013.01); *B24B 7/186* (2013.01)

(58) Field of Classification Search
CPC ..... B24B 45/00; B24B 45/006; B24B 7/18; B24B 7/186; B24B 23/02; B24B 23/028; B24D 7/02; B24D 7/04; B24D 7/06; B24D 7/063; B24D 7/066; B24D 7/08; B24D 7/18; B24D 13/14; B24D 13/142; B24D 13/145; B24D 13/16; B24D 9/003; B24D 9/08; B24D 9/085
(Continued)

(56) References Cited

U.S. PATENT DOCUMENTS 1,417,593 A 5/1922 Christine
2,480,739 A 8/1949 Johson
(Continued)

FOREIGN PATENT DOCUMENTS

CN 1187111 A 7/1998
CN 1946518 A 4/2007
(Continued)

OTHER PUBLICATIONS

International Search Report and Written Opinion for PCT/US2020/046732 mailed Nov. 27, 2020 (12 pages).
(Continued)

*Primary Examiner* — Eileen P Morgan
(74) *Attorney, Agent, or Firm* — THOMPSON HINE LLP

(57) ABSTRACT

A brush assembly is provided for increasing an effective area and uniformity of performance in an abrasive floor polishing application at a given size of brush mount. The brush assembly includes a pad with slots for receiving abrasive blades. The pad includes variable protrusions to provide varied support to the abrasive blades. The blades have a trapezoidal body shape. The blades include abrading components including an abrasive material such as diamonds. In some embodiments, the abrading components include a metallic material, such as copper material. In some embodiments, the abrading components include a phenolic material.

15 Claims, 9 Drawing Sheets

(51) Int. Cl.

| | |
|---|---|
| ***B24B 23/02*** | (2006.01) |
| ***B24D 7/06*** | (2006.01) |
| ***B24D 7/18*** | (2006.01) |
| ***B24D 9/08*** | (2006.01) |

(58) Field of Classification Search
USPC ..... 451/360, 363, 466, 469, 496, 497, 498, 451/522, 548
See application file for complete search history.

(56) References Cited

U.S. PATENT DOCUMENTS

| | | | | |
|---|---|---|---|---|
| 2,597,421 | A | 5/1952 | White | |
| 3,522,342 | A | 7/1970 | Nungesser et al. | |
| 3,541,740 | A | 11/1970 | Radik | |
| 3,605,347 | A | 9/1971 | Barry | |
| 3,696,563 | A | 10/1972 | Rands | |
| 3,871,139 | A | 3/1975 | Rands | |
| 3,890,746 | A * | 6/1975 | Saegusa | B24D 13/06 451/469 |
| 3,913,282 | A | 10/1975 | Whitssett | |
| 4,037,369 | A | 7/1977 | Campbell | |
| 4,236,269 | A | 12/1980 | Block | |
| 4,490,872 | A | 1/1985 | Drumm | |
| 4,493,126 | A | 1/1985 | Uy | |
| 4,493,170 | A | 1/1985 | Hanger | |
| 4,507,361 | A | 3/1985 | Twiley et al. | |
| 4,561,214 | A | 12/1985 | Inoue | |
| 4,614,380 | A | 9/1986 | Allen | |
| 4,625,466 | A | 12/1986 | Kaish | |
| 4,662,044 | A | 5/1987 | Kaybara | |
| 4,835,912 | A | 6/1989 | Block | |
| 5,050,262 | A | 9/1991 | Malish | |
| 5,155,945 | A | 10/1992 | Tyler et al. | |
| 5,224,231 | A | 7/1993 | Nacar | |
| 5,309,681 | A | 5/1994 | Cheney et al. | |
| 5,323,505 | A | 6/1994 | Montabauer et al. | |
| 5,396,680 | A | 3/1995 | Belanger | |
| 5,438,728 | A | 8/1995 | Kubes et al. | |
| 5,445,438 | A | 8/1995 | Drumm | |
| 5,454,752 | A | 10/1995 | Sexton et al. | |
| 5,491,025 | A | 2/1996 | Pihl et al. | |
| 5,525,100 | A | 6/1996 | Kelly et al. | |
| 5,649,857 | A | 7/1997 | Suhrheinrich et al. | |
| 5,679,067 | A * | 10/1997 | Johnson | B24D 3/28 451/527 |
| 5,903,951 | A | 5/1999 | Ionta et al. | |
| 5,983,434 | A | 11/1999 | Eichinger et al. | |
| 6,123,612 | A | 9/2000 | Goers | |
| 6,126,533 | A * | 10/2000 | Johnson | A46D 1/00 451/550 |
| 6,196,911 | B1 * | 3/2001 | Preston | B24D 18/00 451/529 |
| 6,234,886 | B1 | 5/2001 | Rivard | |
| 6,249,928 | B1 | 6/2001 | Wang | |
| 6,251,002 | B1 | 6/2001 | Close | |
| 6,312,485 | B1 | 11/2001 | Kaiser et al. | |
| 6,352,471 | B1 | 3/2002 | Bange et al. | |
| 6,422,932 | B1 | 7/2002 | Lageson et al. | |
| 6,431,970 | B2 | 8/2002 | Eberhard | |
| 6,457,202 | B1 | 10/2002 | Torres et al. | |
| 6,506,100 | B2 | 1/2003 | Blattler | |
| 6,592,442 | B2 | 7/2003 | Hoffheimer | |
| 6,665,902 | B1 | 12/2003 | Vegter | |
| 6,669,746 | B2 | 12/2003 | Niizaki et al. | |
| 6,840,849 | B2 | 1/2005 | Mackay | |
| 6,893,335 | B2 | 5/2005 | Mackay | |
| 7,004,829 | B2 | 2/2006 | Keuler | |
| 7,081,047 | B2 | 7/2006 | Palushaj | |
| 7,144,194 | B2 | 12/2006 | Kipp, Jr. | |
| 7,351,132 | B2 | 4/2008 | Travini | |
| 7,357,705 | B2 | 4/2008 | Miyanaga | |
| 7,690,970 | B2 * | 4/2010 | Palushaj | B24B 7/186 451/353 |
| 7,727,056 | B2 | 6/2010 | Gilles | |
| 8,105,134 | B2 * | 1/2012 | Palushaj | A46D 1/00 451/490 |
| 9,102,029 | B2 | 8/2015 | Palushaj | |
| 9,492,909 | B2 | 11/2016 | Palushaj | |
| 9,776,305 | B2 | 10/2017 | Palushaj | |
| 9,796,067 | B2 | 10/2017 | Palushaj | |
| 2002/0094437 | A1 | 7/2002 | Niizaki et al. | |
| 2002/0148059 | A1 | 10/2002 | Lin | |
| 2002/0182983 | A1 | 12/2002 | Yamamoto et al. | |
| 2005/0260940 | A1 | 11/2005 | Palushaj | |
| 2006/0014482 | A1 | 1/2006 | Wentworth et al. | |
| 2006/0025059 | A1 | 2/2006 | Gueorguiev et al. | |
| 2015/0306738 | A1 * | 10/2015 | Palushaj | B24D 13/16 451/497 |

FOREIGN PATENT DOCUMENTS

| | | | | |
|---|---|---|---|---|
| CN | 101421076 | A | 4/2009 | |
| CN | 102216031 | A | 10/2011 | |
| CN | 104044064 | A | 9/2014 | |
| CN | 204016201 | U | 12/2014 | |
| CN | 104903051 | A | 9/2015 | |
| CN | 206357009 | U | 7/2017 | |
| CN | 206883355 | U | 1/2018 | |
| CN | 207289812 | U | 5/2018 | |
| CN | 109689301 | A | 4/2019 | |
| CN | 109789529 | A | 5/2019 | |
| DE | 2411749 | A1 | 9/1975 | |
| DE | 102012216000 | A1 | 3/2014 | |
| DE | 202015106711 | U1 | 3/2017 | |
| EP | 0922535 | A1 | 6/1996 | |
| EP | 2990156 | A1 | 3/2016 | |
| GB | 1262020 | A | 2/1972 | |
| WO | 96-33638 | A1 | 10/1996 | |
| WO | 99-03643 | A | 1/1999 | |
| WO | 2005113198 | A2 | 12/2005 | |
| WO | 2006039811 | A1 | 4/2006 | |
| WO | 2008088908 | A1 | 7/2008 | |
| WO | 2019010508 | A1 | 1/2019 | |
| WO | WO-2021034790 | A1 * | 2/2021 | B24D 13/14 |

OTHER PUBLICATIONS

PCT International Search Report dated Dec. 22, 2009 for PCT/US2009/056056 (3 pages).

Non-Final Office Action for U.S. Appl. No. 14/788,824 mailed Mar. 13, 2017 (16 pages).

* cited by examiner

FLOOR POLISHING APPARATUS

CROSS-REFERENCE TO RELATED APPLICATIONS

This application claims priority to U.S. Provisional Patent Application No. 62/888,847 filed on Aug. 19, 2019, which application is hereby incorporated herein by reference in its entirety.

BACKGROUND

Concrete is traditionally used for floors in both residential and commercial applications in view of its robustness and economic benefits. Depending upon the circumstances, the concrete may be left unfinished, partially finished or completely finished wherein a high gloss decorative service is obtained.

In warehouses, factories, etc., concrete floors are polished by rotary driven machines that employ brushes positioned on the underside of the machinery whereby the machinery traverses the floor to provide a clean surface. Generally, efficiency in polishing operations is desirable, in any or all of, e.g., the varieties of brushes needed (e.g., different grit values), the number of passes over the floor required, the cleaning area of the brushes, the uniformity of the performance of the brushes, and the durability of the brushes.

Accordingly, it is desirable to maximize the effective area of substantially uniform floor treatment in a brush device within typical operating bounds of an ordinary cleaning machine, such as a Tennant or Advance brand scrubber machine. It is also desirable to provide uniformly performing, relatively high material removal capabilities, with durable materials, to minimize the number of passes and brush devices that may be required.

DETAILED DESCRIPTION

Ordinary floor cleaning machines typically use a pair of brush devices in a fixed, staggered configuration. The brush locations are generally set to provide an overlap in the effective areas of the pair of brushes, to provide a single, larger effective area for the machine—and for many floor machines, the configuration corresponds to minimal overlap for scrubbing or sweeping brushes.

Utilizing ordinary floor cleaning machines for more applications provides inherent efficiencies. Abrasive brush devices have been developed to be compatible with typical floor scrubbing machines but provide new functionality. However, different brushes may have different effective areas, such that designing the machine for one type of brush may result in a gap between the effective areas for a different kind of brush. Specifically, as forces on a brush increase with the abrasive properties, it is relatively difficult to provide an abrasive brush with an equal effective area as a sweeping or mopping brush—when each brush is for the same size mount on a floor polishing machine—because the effect of the higher forces is most pronounced at the outer bounds of the brush area.

Figure 1:
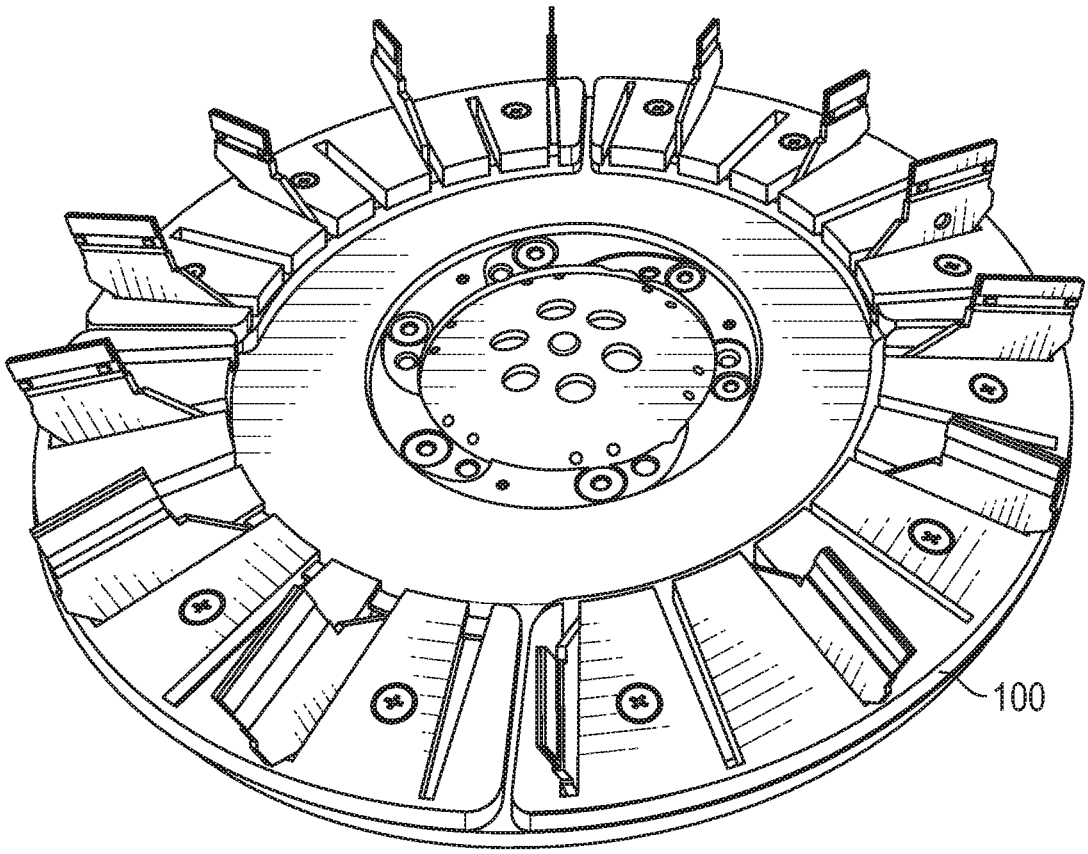
FIG. 1 (Prior Art)
FIG. 1 is a perspective view of a prior art abrasive brush.
Figure 2A:
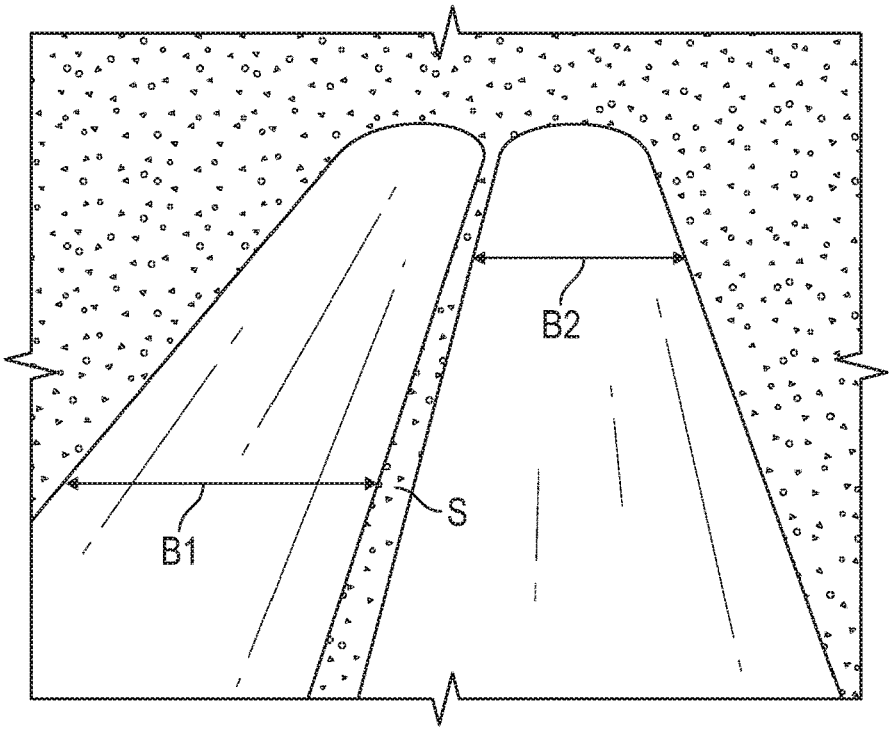
FIG. 2A is a perspective view of a floor segment in which a pair of prior abrasive brushes with a segmented effective area has made a pass, leaving a less treated strip of floor in the middle.
Figure 2B:
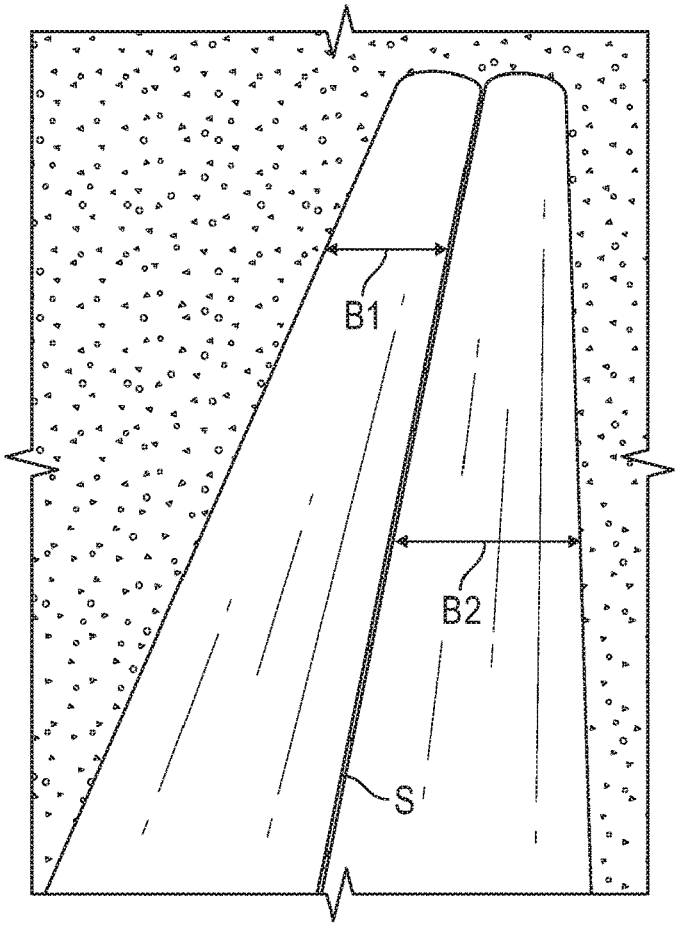
FIG. 2B is a perspective view of another floor segment in which a pair of prior abrasive brushes with a segmented effective area has made a pass, leaving a less treated strip of floor in the middle.

Some abrasive brush devices, such as the prior abrasive brush in FIG. 1, extend the abrasive elements up to or outside of the footprint of the base of the brush to provide an effective area larger than the base. However, e.g., outer portions of such devices may be less effective and less uniform—as the abrasive elements are further from the base, the base provides less direct support, and the outer portions of brushes may bend or lift and result in uneven pressure along the abrasive element. In such circumstances, the effective area of uniform performance of a single brush is reduced. Moreover, referring to FIGS. 2A-B, with some machines, a pair of effective brush areas B1 and B2, that have overlapping footprints parallel to the floor when in a static state, leave a strip of untreated or significantly less treated floor S between them. The higher the material removal characteristics of the brush, the more pronounced such inconsistent results may be. In such circumstances, additional passes over a floor area may be required to achieve a uniform result.

Figure 3:
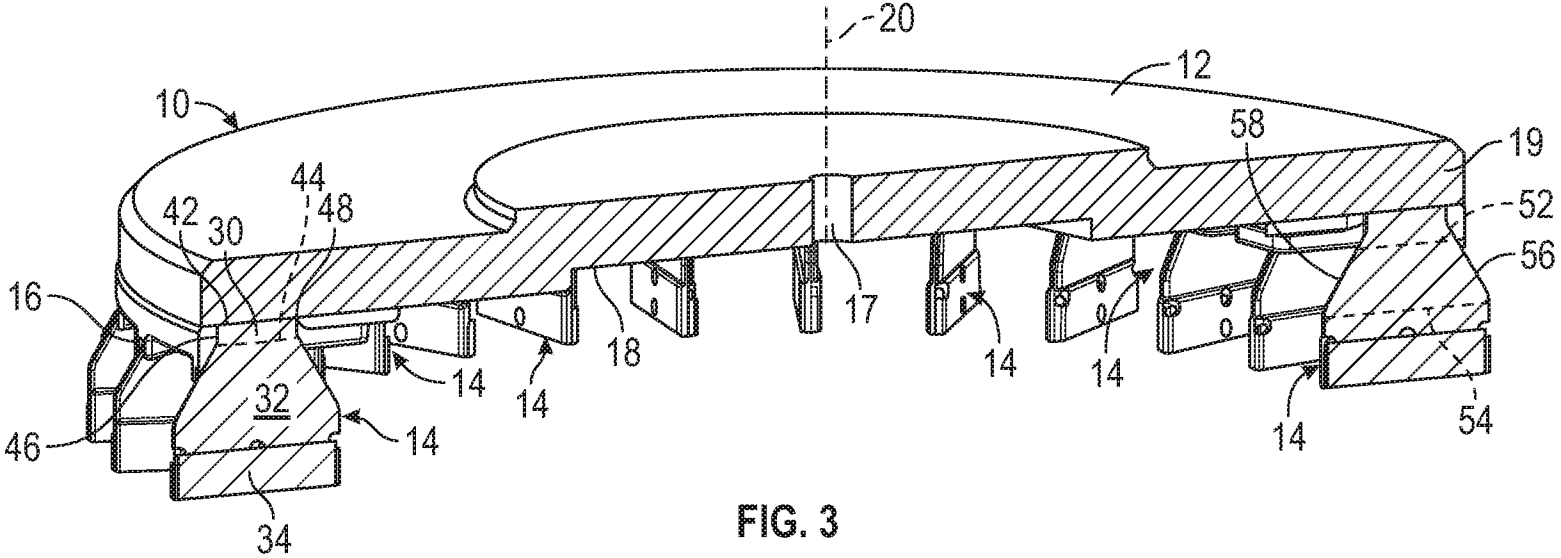
FIG. 3 is a perspective cutaway view of a polishing device according to the principles of the present disclosure.
Figure 4:
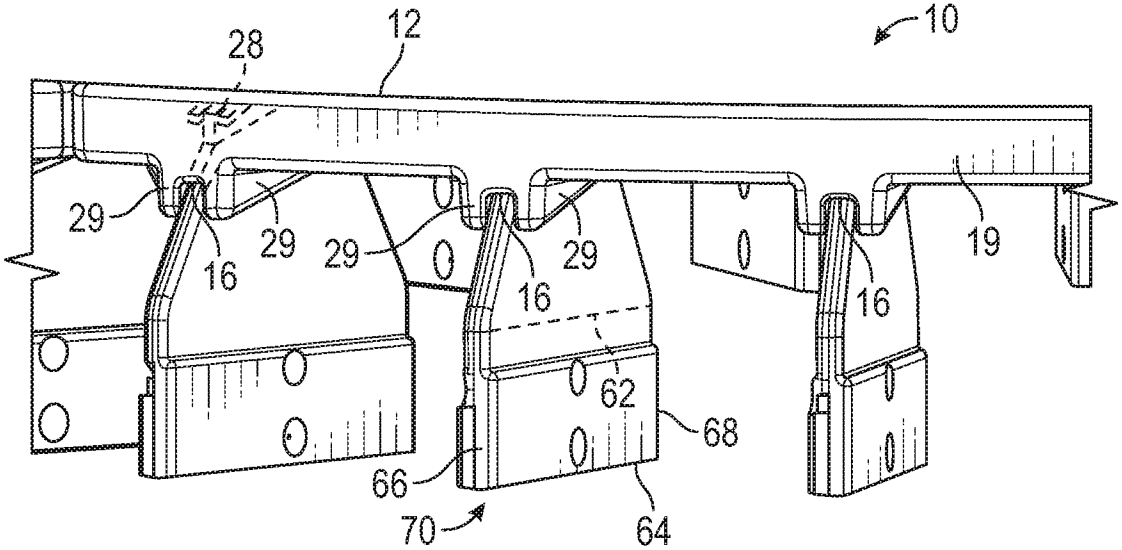
FIG. 4 is a partial perspective view of a polishing device according to the principles of the present disclosure.
Figure 9:
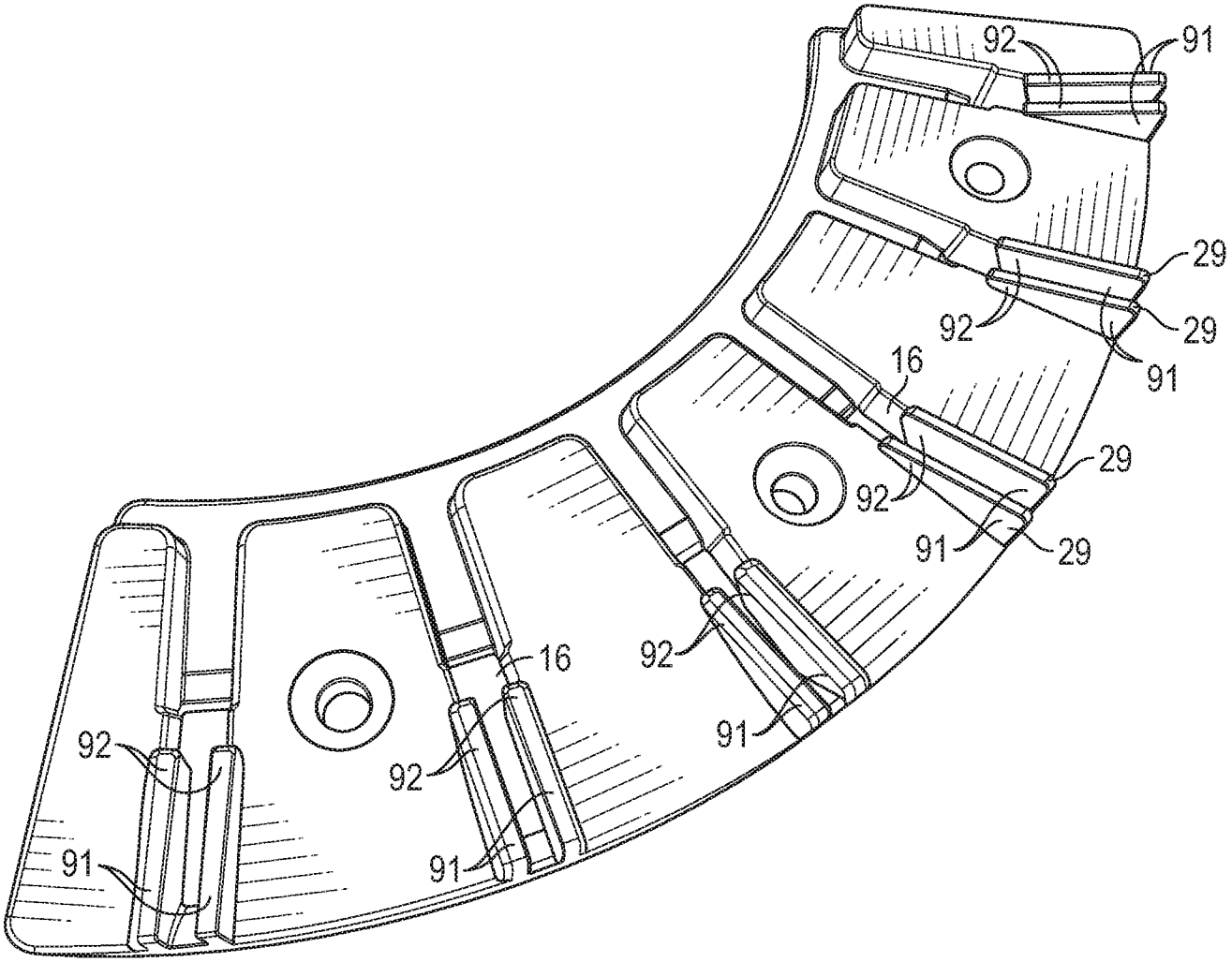
FIG. 9 is a perspective view of part of a pad component according to the principles of the present disclosure.

According to the principles of the present disclosure, an improved polishing device 10 provides an increased effective area of performance in an abrasive floor polishing application at a given size of brush mount. Referring to FIGS. 3-4 and 9, the device 10 includes a circular-shaped pad 12 having a plurality of blades 14 retained within slots 16 of the pad 12. The pad 12 has an internal diameter 18 that is operable to receive the drive shaft of a rotary machine, including an automatic flooring machine (not shown). The flooring machine can be of the type that traditionally cleans concrete floors as is well known in the art in which the circular face of the pad is positioned substantially parallel to the floor. The drive shaft may impart motion to the pad 12 at approximately 125 to 200 rpms while applying approximately 150 to 200 lbs. of total pad pressure. The device 10 can be used in low speed, low pressure conditions. However, it is possible to utilize the various devices disclosed herein in higher speed applications where higher pressures are encountered. For example, if desired, the present invention could be used with machines operating in the 125-1500 RPM range and at head pressures in the 50-800 PSI range. Polishing devices 10 may be used in pairs in a staggered configuration as is typical with such flooring machines.

The pad 12 may be approximately 6 to 20 inches in diameter and, in some embodiments, is made of a material or materials that are resistant to corrosion, e.g., plastic, yet having sufficient rigidity to substantially maintain its shape within the operating conditions of the polishing device 10, e.g. the rotation speed and head pressure ranges disclosed herein. In some embodiments, the pad 12 includes composite materials.

The slots 16 open at a bottom surface 17 of the pad 12. The slots 16 extend radially inwardly from a radially outer edge area 18 of the pad 12. In some embodiments, the slots 16 extend along equal radial lengths and are equally radially located relative to a center 20 of the pad 12. The slots 16 are circumferentially spaced about the pad 12. In some embodiments, the slots 16 are equally circumferentially spaced about the pad 12. In one exemplary embodiment, the pad 12 includes twenty-four of the slots 16, each of the slots 16 having the same radial length, each of the slots 16 equally radially positioned between the outer edge area 18 and the center 20. The slots 16 engage the blades 14 to removably secure the blades 14 relative to the pad 12. For example, in some embodiments, along an axially inward direction from the bottom surface 17 of the pad 12, the slots 16 at least in part widen in the circumferential direction to receive corresponding protrusions 28 of the blades 14 and thereby secure the blades 14 to the pad 12 in at least the axial and circumferential directions. With such a configuration, the blades 14 engage the pad 12 with the protrusions 28, and the blades 14 extend beyond the bottom surface 17 of the pad 12 outside of the slots 16. In some embodiments, the slots 16 are closed at the radially outward end thereof, and the blades 14 may otherwise radially secured in known ways, such as by snap fit, with a fastener, etc.

The pad 12 also includes variable protrusions 29 extending from the bottom surface 17. In some embodiments, the variable protrusions 29 are angled ridges, and in some such embodiments the protrusions extend linearly from one end to the other. The variable protrusions 29 extend at least partially around the slots 16, with the ridges 29 having a peak end 91 and a base end 92, the peak end 91 extending further axially away from the bottom surface 17 than the base end 92. The ridges 29 are oriented with the peak end 91 oriented along the radially outer portions of the slots 16.

Each of the blades 14 include a tab end 30, a trapezoidal body 32, and an abrasive end 34. Each of the tab 30, the trapezoidal body 32, and the abrasive end 34 substantially maintains its shape across the thickness thereof. The faces of tab end 30, trapezoidal body 32, and abrasive end 34 are oriented parallel to each other and, to the extent that the thicknesses correspond to each other, are coplanar. It should be understood that the tab end 30, trapezoidal body 32, and abrasive end 34 may have a variety of configurations and materials. For example, in some embodiments, the tab end 30, the trapezoidal body 32, and a portion of the abrasive end 34 are a unitary body made of plastic, and the abrasive end 34 further includes a component of a different material, such as metal with diamonds sintered thereto, as is further disclosed herein.

The tab end 30 has a substantially rectangular shape and is configured to engage with one of the slots 16 to removably secure the respective blade 14 to the pad 12. The tab end 30 has a top rectangular portion 42 extending along the one of the slots 16, an opposing bottom rectangular portion 44, and side rectangular portions 46, 48 extending axially away from the bottom surface 17 of the pad 12. The side rectangular portions 46, 48 are laterally spaced across the tab end 30. In some embodiments, protrusions 28 extend outwardly, in opposing directions, respectively, along the top rectangular portion 42 of the tab end 30. Accordingly, the tab end 30 is thicker at the top rectangular portion 42 and engages with an axially inward and circumferentially wider portion of the respective one of the slots 16. With the tab end 30 secured to the pad 12 axially inward of the bottom surface 17, the trapezoidal body 32 and the abrasive end 34 extend away from the bottom surface 17 outside of the slots 16.

A top base portion 52 of the trapezoidal body 32 is disposed at the bottom rectangular portion 44 of the tab end 30. In some embodiments, the bottom rectangular portion 44 of the tab end 30 is coincident with the top base portion 52 of the trapezoidal body 32. The trapezoidal body 32 has a bottom base portion 54 wider than the top base portion 52, with each end of the bottom base portion 54 laterally overlapping and extending laterally outside of one of the ends of the top base portion 52, respectively. The bottom base portion 54 is longitudinally spaced from the top base portion 52; i.e. the bottom base portion 54 is spaced axially away from the top base portion 52 when the respective blade 14 is secured to the pad 12 in one of the slots 16. Leg portions 56, 58 of the trapezoidal body 32 linearly extend between the ends of the top and bottom base portions 52, 54, respectively. With the respective blade 14 secured to the pad 12 in one of the slots 16, the leg portions 56, 58 extend between the ends of the top and bottom base portions 52, 54, respectively, with the leg portions 56, 58 disposed in opposing radial orientations, respectively. In some embodiments, the trapezoidal body 32 has a shape substantially that of an isosceles trapezoid; i.e., that the parallel top and bottom base portions 52, 54 are centered relative to each other and the leg portions 56, 58 are the same length with mirrored orientations.

The abrasive element 34 is disposed at the bottom base portion 54 of the trapezoidal body 32. The abrasive element 34 has a substantially rectangular shape with longitudinally-spaced top and bottom portions 62, 64 and laterally-spaced side portions 66, 68. In some embodiments, the top portion 62 of the abrasive element 34 is coincident with the bottom base portion 54 of the trapezoidal body 32. In some embodiments, the tab end 30, the trapezoidal body 32, and the abrasive element 34 are all centered along a longitudinal direction.

The abrasive element 34 includes an abrading component 70 protruding outside of an abrasive housing 72 at the bottom portion 64. The abrading component 70 defines the longitudinal extremity opposite the tab end 30 of each respective blade 14; i.e., with the respective blade 14 secured to the pad 12 in one of the slots 16, the abrading component 70 is the furthest part of the respective blade 14, in the axial direction, from the bottom surface 17 of the pad 12. In some embodiments, with the blades 14 respectively each secured to the pad 12 in one of the slots 16, each of the respective abrading components 70 extends radially outside of the pad 12.

In some embodiments, the abrading component 70 includes a relatively rigid base material with an abrasive material adhered thereto. The abrasive material can be diamonds or the like. The diamonds may be equally distributed on the exterior surface of the abrading component 70.

According to the principles of the present disclosure, the abrasive end of one of the blades may have a variety of configurations and may accommodate a variety of abrading components. Referring to FIGS. 7A-E, a blade 114, configured with a relatively rough grit characteristic, includes an abrasive end 134 securing an abrading component 170. The abrasive end 134 and the abrading component 170 are configured to provide a relatively small axial protrusion of the abrading component 170 outside of the abrasive end 134. An abrasive housing 172 defines a slot 174 for receiving all of the abrading component 170 other than a protruding end 176. The abrading component 170 may be secured within the abrasive housing 172 with a variety of known techniques, including by overmolding.

Referring to FIGS. 8A-E, a blade 214, configured with a relatively finer grit characteristic relative to blade 114 of FIG. 7, includes an abrasive end 234 securing an abrading component 270. The abrasive end 234 and the abrading component 270 are configured to expose a larger portion of the abrading component 270 as compared to the blade 114 and its abrading component 170, where the blades 114 and 214 have the same overall footprint size. An abrasive housing 272 is relatively shorter than the abrasive housing 172 and includes a slot 274 for receiving the abrading component 270 with a relatively larger protruding end 276. The protruding end 276, in some embodiments, laterally protrudes to overlap the end of the abrasive housing 272 outside of the slot 274. The abrading component 270 may be secured within the abrasive housing 272 with a variety of known techniques, including by overmolding. The abrading component 270 may include an t-shaped cross-section at the interior end to provide additional engagement of the abrading component 270 to the abrasive housing 272.

It should be understood that the descriptions herein of blades 14, 114, and 214, and of the components thereof, apply to each other, unless expressly distinguished.

In some embodiments of a blade 14 according to the principles of the present disclosure, the tab end 30, the trapezoidal body 32, and the abrasive housing 72 of the abrasive element 34 are formed with a thermoplastic elastomer material such as Hytrel material. These components may be overmolded onto the abrading element 70.

In some embodiments, including for example, abrading element 170 of blade 114, the abrading element includes a metal material mixed with an abrasive material. In some embodiments, the metal is copper, and the abrasive material is diamond. In such embodiments, the metal may be compressed powder metal. The abrading element 170, in a copper-based formulation, is, in some embodiments, cold-pressed into the desired shape and has diamond adhesive material sintered thereto. In some embodiments, the pre-manufacturing diamond content of the abrading element, by weight, is between approximately 15% and 30%, and, in one such embodiment, is 22%.

The abrading element 70 includes, in some embodiments, apertures 80, so that the abrading element may be secured during the overmolding process. Apertures 80 may be formed, for example, by cutting the abrading element 70 with a water jet.

The blades 14 of the present disclosure may be configured with the diamond grit sizes such as 200 and 400 and, with the combination of configuration and materials of the present disclosure, may provide efficient, uniform operation with overlapping effective areas when employed with ordinary floor cleaning machines. As compared to existing abrading components, the polishing device 10 including copper and diamonds in the abrading component 70 in the blades 14 is capable of increasing the material removal capability—measured by time spent—up to a factor of four.

In some embodiments, including for example, abrading element 270 of blade 214, the abrading element 270 includes a phenolic material mixed with an abrasive material. In such embodiments, the abrading element 270 may be formed by injection molding. In some such embodiments, the pre-manufacturing diamond content of the abrading element, by weight, is between approximately 15% and 30%, and, in one such embodiment, is 22%.

Polishing devices 10 may operate in pairs with machines operating each of the devices in the 125-1500 RPM range and at head pressures in the 50-800 PSI range. The polishing devices 10 interface with a floor only with the abrading components 70 of the plurality of blades 14. Polishing devices 10 may be staggered so that the areas of the respective polishing devices overlap.

According to the principles of the present disclosure, the trapezoidal body 32 of the blade 14 substantially uniformly transmits pressure from the pad 12 to the abrading component 70, including where the abrading component 70 may extend radially outside of the pad 12.

In operation, the blades 14 of the polishing devices 10 may be subjected to unequal bending forces due to, e.g. the higher speed of the radially outside part of the blades 14. According to the principles of the present disclosure, the ridges 29 variably support the blades 14 against bending, with the peak end 91, the larger portion of the ridges 29, being disposed at the radially outward part of the slots 16 and, thus, variably reducing the effective bendable height of the blades 14. With this added support to the radially outside part of the blades 14, the effective bending forces experienced across the blades 14 may be made substantially uniform, with the dimension of the ridges being configured in accordance with the material and size of the blades and the desired operating settings of the machines.

According to the principles of the present disclosure, in some embodiments, the polishing device 10 incorporates both the trapezoidal body 32 in the blades 14 and the ridges 29 on the pad 12.

Figure 5:
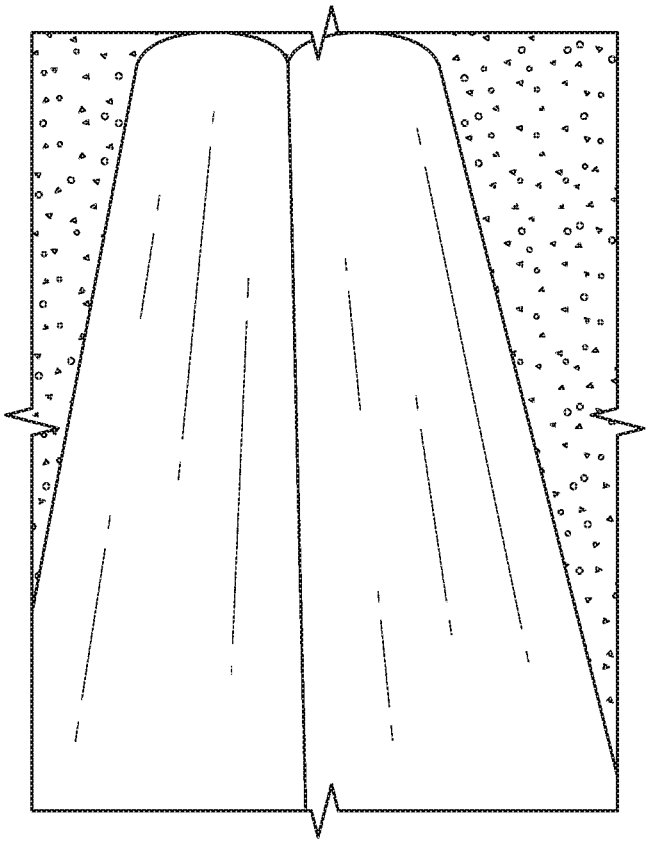
FIG. 5 is a perspective view of a floor segment in which a pair of polishing devices according to the principles of the present disclosure have made a pass, providing a substantially continuous, uniform effective area of treatment.
Figure 6:
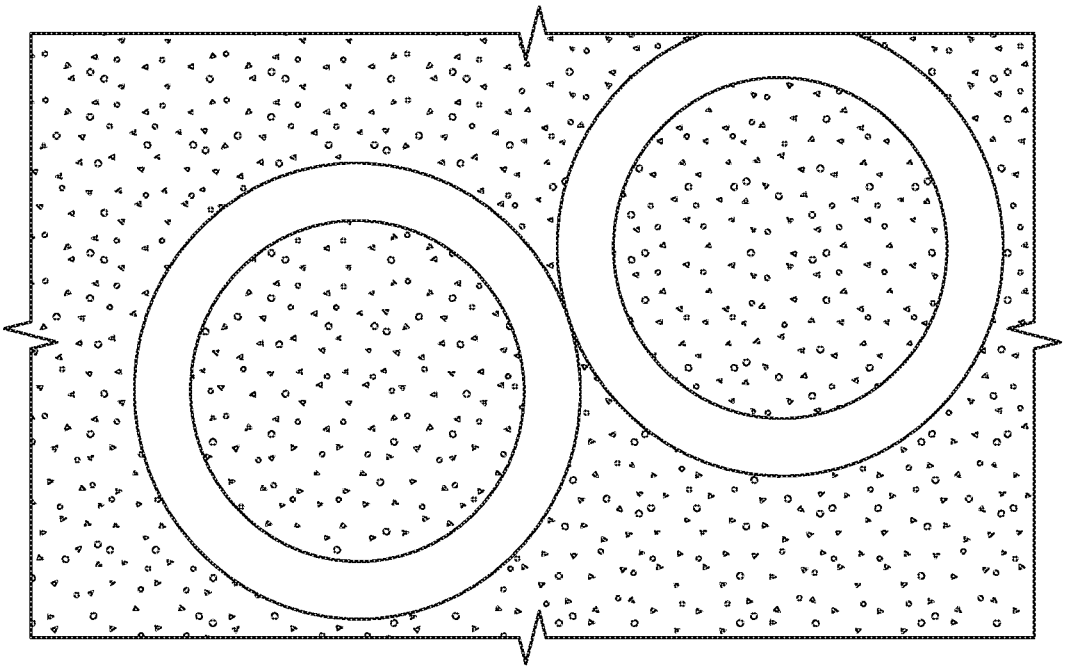
FIG. 6 is a top view of a floor segment in which a pair of polishing devices have statically operated.
Figure 7A:
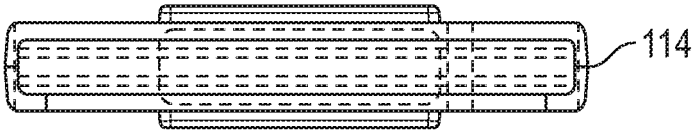
FIGS. 7A-E includes perspective and side views of a blade component according to the principles of the present disclosure.
Figure 7B:
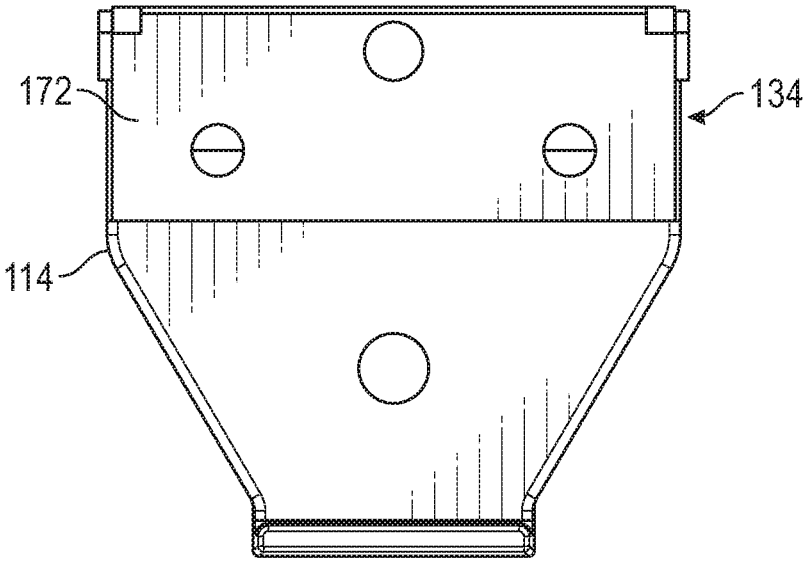
Figure 7C:
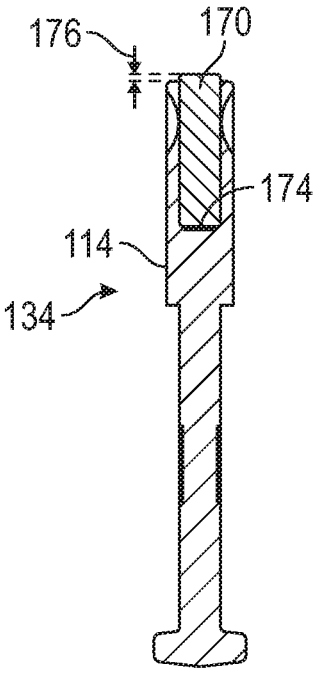
Figure 7D:
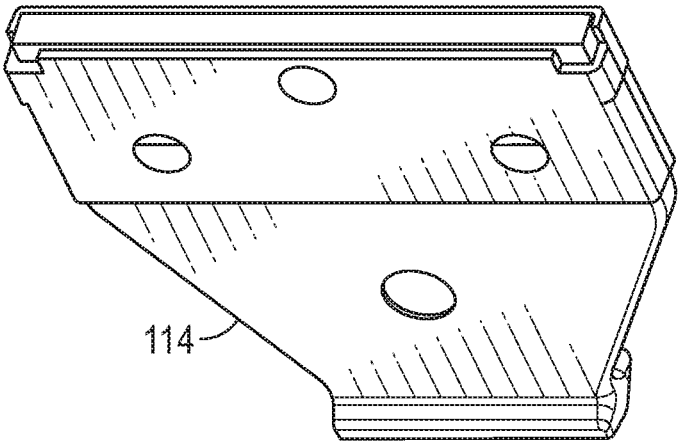
Figure 7E:
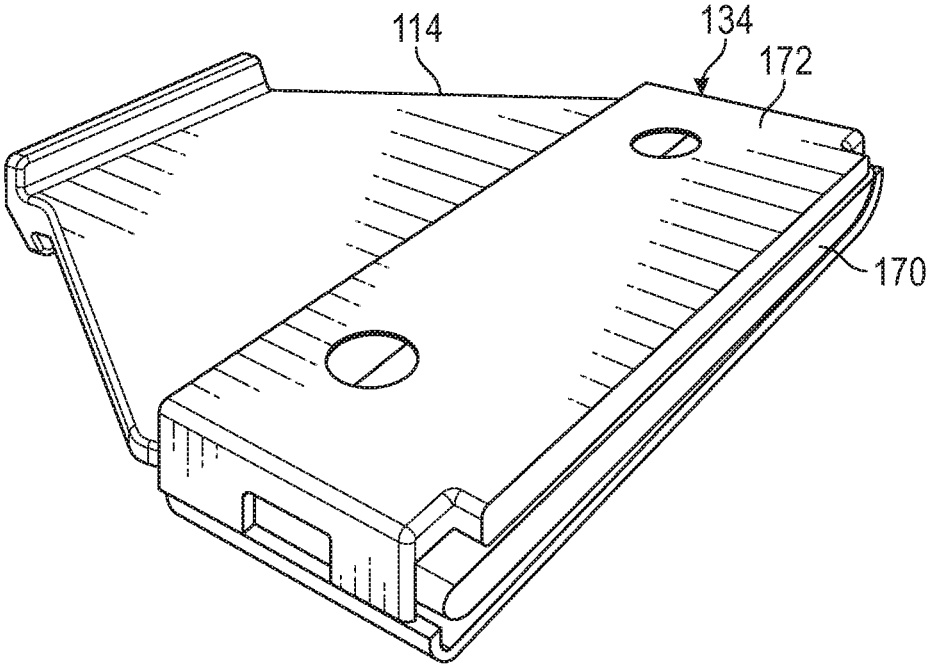
Figure 8A:
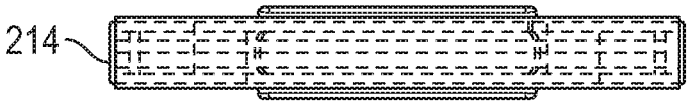
FIGS. 8A-E includes perspective and side views of another blade component according to the principles of the present disclosure.
Figure 8B:
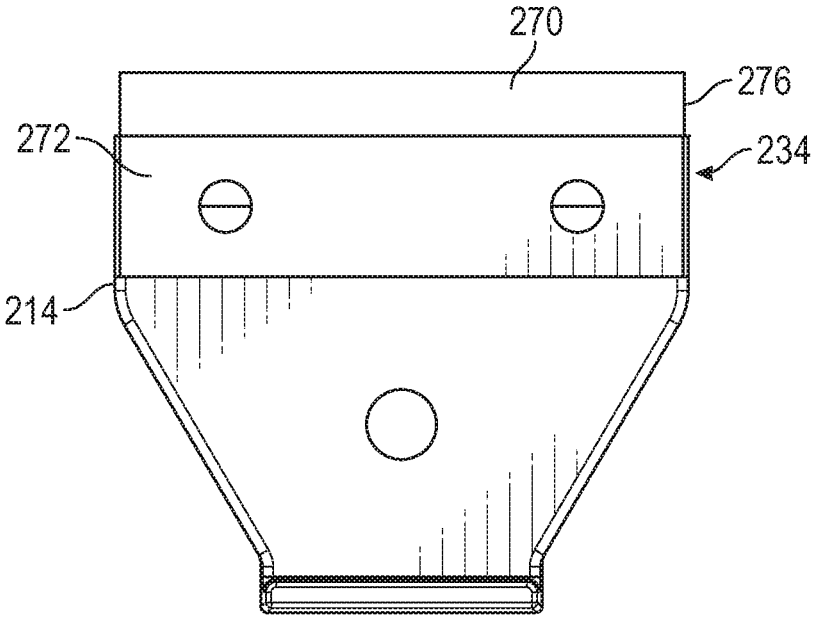
Figure 8C:
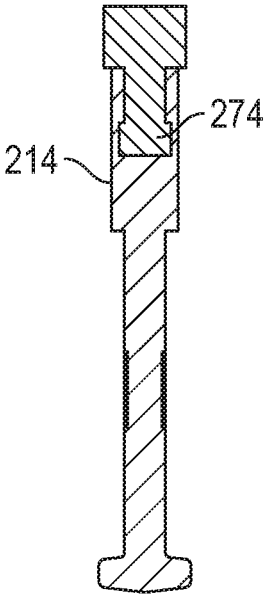
Figure 8D:
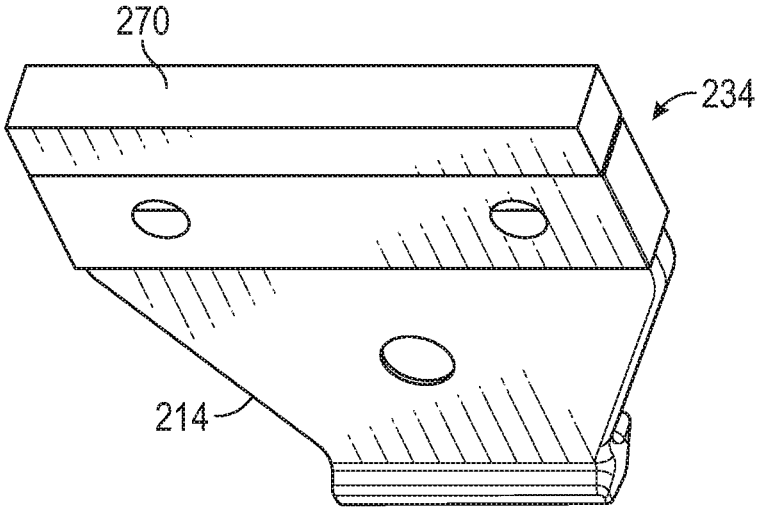
Figure 8E:
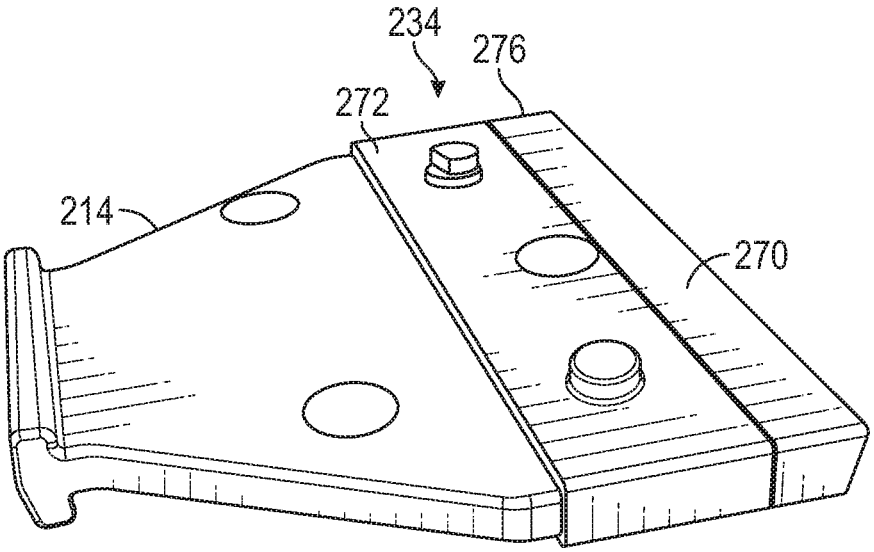

The device 10 provides a substantially continuous and uniform abrasive performance when used with a typical flooring machine—alone or in multiple configurations. FIG. 5 shows a floor segment treated with a pair of devices according to the principles of the present disclosures, under substantially the same operating conditions—including rotary speed, pressure, mount sizes, mount locations, type of floor, and environment—as the floor treatments with prior abrasive brushes illustrated in FIGS. 1-2. FIG. 6 illustrates, through the result of static operation of a floor machine with a pair of devices according to the principles of the present disclosure and under the same conditions noted above, that the effective areas of the pair of brushes as used in FIG. 5 overlap to provide a combined continuous, uniform effective area of the devices 10.

The disclosure has been described in an illustrative manner, and it is to be understood that the terminology which has been used is intended to be in the nature of words of description rather than of limitation. "Substantially" as used herein means that a dimension, time duration, shape, or other adjective may vary slightly from what is described due to physical imperfections, power interruptions, variations in machining or other manufacturing, etc. Many modifications and variations of the present disclosure are possible in light of the above teachings, and the disclosure may be practiced otherwise than as specifically described.

What is claimed is:

1. An abrasive blade component for a brush assembly, the abrasive blade component comprising:

a retainer portion having a top end, a longitudinally spaced distal end, and a trapezoidal body in between, the top end including outwardly extending protrusions configured to engage a slot of a brush pad, the trapezoidal body interfacing the top end with a top base side and the distal end with a bottom base side, the bottom base side being longer than the top base side, the retainer portion including two opposing leg sides extending in opposing lateral directions between the top and bottom base sides; and an abrading element coupled to the retainer portion at the distal end, the abrading element extending outside of the retainer portion and defining at least a portion of a longitudinal perimeter of the abrasive blade component.

2. The abrasive blade component of claim 1, wherein the trapezoidal body has an isosceles trapezoidal shape.

3. The abrasive blade component of claim 1, wherein the abrading element includes a metallic material and an abrasive material.

4. The abrasive blade component of claim 3, wherein the metallic material is a copper material.

5. The abrasive blade component of claim 1, wherein the abrading element includes a phenolic material.

6. The abrasive blade component of claim 1, wherein the abrading element extends longitudinally outside of the retainer portion and overlaps the retainer portion in opposing outward directions.

7. An abrasive blade component for a brush assembly, the abrasive blade component comprising:

a retainer portion having a top end, a longitudinally spaced apart distal end, and a body in between, the top end including outwardly extending protrusions configured to engage a slot of a brush pad, the body having a top base side and a bottom base side, wherein the body is trapezoidal in shape in lateral side view such that the bottom base side is longer than the top base side, the body including two opposing leg sides extending at least partly away from each other in opposing lateral directions between the top base side and the bottom base side; and an abrading element coupled to the retainer portion at the distal end, the abrading element extending outside of the retainer portion and defining at least a portion of a longitudinal perimeter of the abrasive blade component;

wherein the body of the retainer has a first face spaced apart from a second face to define a thickness of the body portion, the first face being parallel to the second face.

8. The abrasive blade component of claim 7, wherein the trapezoidal shape of the body is an isosceles trapezoidal shape.

9. The abrasive blade component of claim 7, wherein the abrading element includes a metallic material and an abrasive material.

10. The abrasive blade component of claim 9, wherein the metallic material is a copper material.

11. The abrasive blade component of claim 7, wherein the abrading element includes a phenolic material.

12. The abrasive blade component of claim 7, wherein the abrading element extends longitudinally outside of the retainer portion and overlaps the retainer portion in opposing outward directions.

13. The abrasive blade component of claim 7, wherein the trapezoidal shape of the body substantially uniformly transmits pressure downward to the abrading element.

14. A brush assembly, comprising:

a substantially round pad including a bottom housing, the bottom housing having a plurality of slots, the plurality of slots being aligned along circumferentially spaced radial directions with respect to the pad, respectively, the bottom housing including a plurality of axially-extending variable protrusions extending from the body and aligned along circumferentially spaced radial directions, the plurality of axially-extending variable protrusions each having a peak end and a base end, the peak ends extending further axially away from the bottom housing than the respective base ends, the plurality of axially-extending variable protrusions each being disposed along one of the plurality of slots with the respective peak end at a radially outward position; and an abrasive blade component including:

a retainer portion having a top end, a longitudinally spaced apart distal end, and a body in between, the top end including outwardly extending protrusions configured to engage a slot of a brush pad, the body having a top base side and a bottom base side, wherein the body is trapezoidal in shape in lateral side view such that the bottom base side is longer than the top base side, the body including two opposing leg sides extending at least partly away from each other in opposing lateral directions between the top base side and the bottom base side; and an abrading element coupled to the retainer portion at the distal end, the abrading element extending outside of the retainer portion and defining at least a portion of a longitudinal perimeter of the abrasive blade component;

wherein the abrasive blade component is removably engaged on the pad at one of the slots with the abrasive blade component laterally oriented along the one of the slots and with the abrasive blade component circumferentially interfacing with one of the plurality of the axially-extending variable protrusions.

15. A brush assembly, including the abrasive blade component of claim 1, the brush assembly comprising:

a substantially round pad including a bottom housing, the bottom housing having a radially outer perimeter and a plurality of slots, the plurality of slots being aligned along circumferentially spaced radial directions with respect to the pad, respectively, the bottom housing including a plurality of axially-extending variable protrusions extending from the body and aligned along circumferentially spaced radial directions, the plurality of axially-extending variable protrusions each having a peak end and a base end, the peak ends extending further axially away from the bottom housing than the respective base ends, the plurality of axially-extending variable protrusions each being disposed along one of the plurality of slots with the respective peak end at a radially outward position; and wherein the abrasive blade component is removably engaged on the pad at one of the slots, wherein part of the abrading element extends radially outward outside of the radially outer perimeter of the pad.

* * * * *